US005368500A

United States Patent [19]

Dedering

[11] Patent Number: 5,368,500

[45] Date of Patent: Nov. 29, 1994

[54] CLOSURE FOR ELECTRIC PLUG

[76] Inventor: Charles E. Dedering, 851 Osborn Ave., Oshkosh, Wis. 54901

[21] Appl. No.: 460

[22] Filed: Jan. 4, 1993

[51] Int. Cl.[5] ..... H01R 13/44; H01R 13/639

[52] U.S. Cl. ..... 439/367; 206/523; 439/133; 439/449

[58] Field of Search ..... 439/133, 134, 135, 149, 439/367, 449; 206/523; 174/138 F, 92

[56] References Cited

U.S. PATENT DOCUMENTS

| | | | |
|---|---|---|---|
| 2,282,908 | 5/1942 | Thompson | 206/523 |
| 3,223,776 | 12/1965 | Piasecki | 174/138 F |
| 3,273,779 | 9/1966 | Mykleby | 206/523 |
| 3,278,674 | 10/1966 | Mattysse et al. | 174/138 |
| 3,421,679 | 1/1969 | Goldman | 206/523 |
| 3,757,031 | 9/1973 | Izraeli | 174/138 F |
| 4,029,896 | 6/1977 | Skinner | 174/138 F |
| 4,339,039 | 7/1982 | Mykleby | 206/523 |
| 4,550,220 | 10/1985 | Kitchens | 174/138 F |
| 4,643,505 | 2/1987 | House et al. | 439/367 |
| 4,698,459 | 10/1987 | Drake | 174/138 F |
| 4,749,363 | 6/1988 | Luska et al. | 439/367 |
| 4,865,557 | 9/1989 | Kershaw | 439/367 |
| 4,963,700 | 10/1990 | Olsen et al. | 174/138 F |
| 5,052,939 | 10/1991 | Koch | 439/133 |
| 5,217,387 | 6/1993 | Hull et al. | 439/367 |

FOREIGN PATENT DOCUMENTS 2234687 6/1973 France .

*Primary Examiner*—Neil Abrams
*Attorney, Agent, or Firm*—R. Jonathan Peters

[57] ABSTRACT

A closure adaptable for protecting an electric plug extending from a vehicle, which comprises a box-like structure having first and second complementary members hingedly connected and interface with each other when the closure is in a closed condition. A recess in a marginal edge of at least one side wall of said member forms an opening along the interface of said first and second members when in closed condition to permit electric wires to extend from said plug outwardly from said closure. A closed cell, cellular polymer is encased in each of said first and second members, (i) said polymer being substantially moisture resistant and compressible, (ii) and said polymer having a combined volume sufficient relative to the combined, interior volume of said closure to permit said first and second members to close when brought into abutting relationship and to substantially envelop said plug thereby forming a water-tight seal.

12 Claims, 2 Drawing Sheets

CLOSURE FOR ELECTRIC PLUG

FIELD OF INVENTION

This invention relates to a closure for protecting an electric plug. In its more specific aspect, this invention relates to a closure for protecting an electric plug, such as a plug extending from the electrical system of a vehicle, and especially to provide a moisture resistant seal.

BACKGROUND AND PRIOR ART

An electric line extending from a power source may terminate with a plug, or have a plug connected thereto, for connection to another line to extend the power beyond the plug. Typically, the plug has one or more female electrical receptacles for accommodating the male connectors from the extension cord. Much of the time the plug is not in use, that is, the plug is hanging free without any electrical hook-up. During this downtime, it is desirable to protect the plug from the elements, especially moisture, so as to inhibit corrosion. Plugs of this type are in common use with vehicles, i.e. automobiles, trucks, and trailers. For example, a plug may be connected to the battery power of an automobile by connecting or hooking-up the lead wire of the plug with the rear lighting system of the automobile. When a trailer is hitched to the automobile, the wires from the trailer are connected to the plug, and consequently the electric power from the automobile will operate the rear lights or tail lights of the trailer. Much of the time, however, the the plug is not in use and hangs freely from the car. It, therefore, is desirable to protect the plug from the elements, but to be able to provide for immediate and easy access to the plug when needed.

Insulating housings or closures for electrical connectors and splices are well known in the art. For example U.S. Pat. No. 4,749,363 discloses a junction box for housing the end socket of an extension cord to prevent access thereto and to protect against electric shock, and comprises box 10 having a hinged cover 11 and side wall openings 23, 24 and 25 for accomodating extension cords 13, 14 and 15. A housing comprising hinged complementary halves is shown in a number of patents, as in U.S. Pat. No. 4,643,505 for housing an extension cord connector having complementary halves 24 and 26. Similarly, U.S. Pat. No. 4,865,557 discloses a closure device for the plug of an electric appliance comprising base 12-B and hinged cover 12-C. U.S. Pat. No. 3,223,776 discloses a cable-tap closure and comprises two integrally hinged box-like half-sections 10 and 12 with end walls having a yieldable barrier of comb-like tines 22. Another protection device is shown in French Patent No. 2234687, which shows a box hinged to enable two halves to be locked together, thereby protecting a wall socket especially from children. U.S. Pat. No. 4,698,459 shows a case having base 10 and hinged cap 12 for protecting the connection between the terminal post of a battery and the battery cable. A closure comprising mating half sections for a wire junction are disclosed in U.S. Pat. No. 4,963,700 and U.S. Pat. No. 3,278,674, and further Patent '700 shows filling one of the sections with a tackified elastomer extended with oil and fillers.

There is no teaching in all of this art of a closure or housing for enclosing and protecting an electric plug when not deployed for establishing an electrical connection, and adaptable for extension from a vehicle, especially for such protection from ambient moisture. A plug of this type typically has one or more female receptacles, and therefore when the plug is not in use, it is susceptible to corrosion particularly because of ambient moisture. This invention has, therefore, as its purpose to provide a closure for protecting such a plug, as one extending from a vehicle, and when not in use. When the plug is to be used, it is removed from the protector, and an electrical connection can be established between the power source of the vehicle and a second hitched vehicle.

SUMMARY OF THE INVENTION

In accordance with my invention, there is provided a closure or housing for enclosing and protecting an electric plug extending from a power source, such as a plug connected to the elecrical system of a vehicle. A plug of this type typically comprises one or more insulated female receptacles connected to a lead wire and adaptable for receiving male conductors having a rod-like or spade-like shape. The free end of the lead wire from the plug is connected to an electrical outlet or power source of a vehicle, such as the rear lighting system. When it is desirable to hook a trailer, for example, to the vehicle, the electric wire for hook-up on the trailer bearing male conductors is connected to the plug, and therefore the power system of the vehicle, e.g. battery, supplies power to the lighting system of the trailer. However, when the plug is not in use, that is, no auxiliary vehicle is hitched to the main vehicle, it is desirable to protect the plug from the elements, especially moisture or water. In order to provide the desired protection, the closure comprises a box-like structure and includes first and second complementary members interconnected by a hinge along one edge of each member. Each member has side walls with marginal edges interfacing with each other in abutting relationship when the closure is closed. The marginal edge of at least one side wall is recessed, preferably the side wall transeversely disposed to the hinge, thereby forming an opening along the interface of the first and second members when in a closed condition to permit the electric wires extending from the plug to extend outwardly from the enclosure.

The interior volume of each of said first and second members is filled with a closed cell, cellular polymer, which is substantially moisture resistant and sufficiently compressible to permit said first and second members to close when deployed to envelop, enclose or contain the electric plug. The combined volume of the closed cell, cellular polymer, which is readily compressible, is sufficient relative to the combined, interior volume of the closure, so that the enclosure can accommodate the plug when in a closed condition, and the polymer being deformable or compressible will substantially completely envelop the plug thereby forming a water-tight seal. The closure is provided with a suitable locking or engagement means or interconnecting means, such as a snap on one member for engaging a detent on the other member.

The closed cell, cellular polymer, such as a closed cell sponge rubber, or closed cell polyethylene foam, or sheet or closed cell silicone rubber sponge, is composed of tiny cells none of which connect with another. These polymers having this independent cell construction are substantially impervious to moisture, which characteristic is maintained over a wide temperature range but will vary depending on the polymer. Many of these polymers are known to maintain their performance over a temperature range of about—40° F. to 220° F., which is more than sufficient for the use embodied by my invention. Because the closed cell, cellular polymer is compressible, the polymer substantially envelops the plug when the closure is deployed and thereby protects the plug from moisture. Additionally, the polymer seals out dirt and vermin, and many such polymers are resistant to ultraviolet light. Further, because of the compressibility of the air within the cells, the polymer exhibits a pneumatic cushioning effect which dampens vibration and shock. Other useful polymers include, for example, polyvinyl chloride, polyimide foam, and a number of rubbers such as neoprene, ethylene-proplylene-diene, and styrene-butadiene, and blends of these rubbers. The polymer can be fabricated to size or cut from a large sheet. Many of these polymeric materials will adhere to the container walls if applied as a viscous liquid or foam, and therefore can be formed in situ which can be a manufacturing advantage. Because the polymer filler in each half-member is compressible and resilient, the polymer is readily conformable to the plug to be protected, but the resiliency of the material returns it to its orginal state. It should be understood, however, that the compressive behavior of the polymer depends on such factors as the polymer composition, density, and cell structure and size, but the optimum composition can be readily determined by one having ordinary skill in the art. Where desired, the closed cell, cellular polymer may be provided with a relatively thin, substantially nonporous, pliable skin as an exterior surface or skin formed integrally with the underside or core of open cell polymer which is compressible and conformable. The harder, nonporous cover or skin is less subject to tearing, and therefore protects the softer underlying core.

In a preferred embodiment of the invention, the closure is provided with a split ring or clip, having a key ring type structure, preferably extending laterally from the hinge and formed integrally therewith. The ring or clip may be provided with a stiffening rib to enhance its integrity, and further the ring or clip has a radial split or slit to permit temporary flexural opening. When a vehicle is hitched to another and the electrical system is connected between vehicles by the plug, the protector or closure can be hung on the electric cable or lead wire from the plug, thereby providing easy storage and quick access of the protector. Thus, when the closure is not deployed as a protector, but rather the plug is being used to make an electrical connection, hanging the protector on the cable or wires minimizes loss of the protector and yet provides for immediate access to the protector when the plug is disconnected. It is preferrable to form the complete unit as an integral unit, such as from extruded or molded polyethylene or polyvinyl chloride.

DETAILED DESCRIPTION OF THE INVENTION

Figure 3:
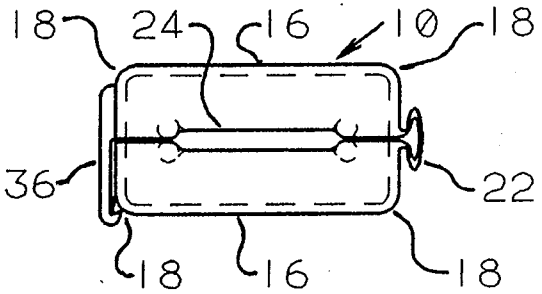
FIG. 3 is a side elevational view of the device of FIG. 1 but in a closed condition.
Figure 1:
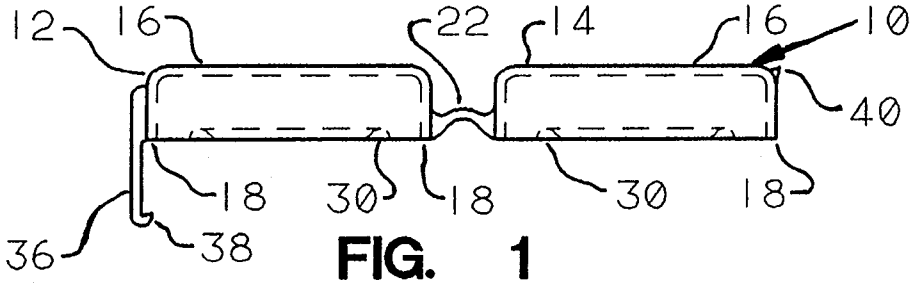
FIG. 1 is a side elevational view of the closure device of my invention.

Referring to the drawings where like reference numerals refer to similar parts throughout the various views, there is shown a closure indicated generally by the numeral 10 comprising complementary first and second members 12 and 14, respectively. Each member has bottom wall 16 of generally rectangular configuration, and opposed side walls 18 and 20 extending transversely from wall 16 to form a box-like half-section of generally rectangular configuration. The depth of the side walls 18 and 20 for each half-section is essentially the same, but where desired the depth for the side walls of one section may be greater than the depth of the side walls for the other section. The two complementary members 12 and 14 are interconnected along a marginal edge of one side wall 18 of each member 12 and 14 by means of flexible or live hinge 22. The complementary members are designed to abut or interface with each other along the marginal edges of the side walls 18 and 20 when pivoted along the hinge in overlapping relationship to provide a closed housing assembly as shown in FIG. 3. In this manner, the closure forms a closable chamber or cavity 24 for receiving and retaining in place a closed cell, cellular polymer 26, as explained hereinbelow in greater detail. It will be observed that the dimensions for each complementary member 12 and 14 may be so chosen that the volume for each is different. The combined volume of the cellular polymer 26 preferably is greater than the volume of the closure chamber 24, but one member can have a larger volume than the other member, for example the volume of member 12 can be greater than the volume of member 14. However, the dimensions of the complementary members, including the depth of the side walls, is such that the plug 28 will fit within the housing and be enveloped by the closed cell, cellular polymer when in the closure attitude. In the preferred embodiment of my invention, members 12 and 14 are symmetrical, having essentially the same dimensions.

Where desired, the closure may be fabricated as an integral unit, and desirably molded as by injection molding of a suitable plastic such as polyethylene, polypropylene, polyvinyl chloride, nylon, etc. These plastic materials are well known in the art, and can be readily formulated to be sufficiently flexible, and further to be wear resistant and also resistant to oil, water, and oxidation. In this manner, the closure will exhibit a useful life in its normal environment.

At least one side wall 18 of member 12, and preferably both side walls 22 of members 12 and 14, is recessed at 30 to provide an elongated opening 32 along the interface of the complementary member 12 and 14 when in a closed attitude (see FIG. 3) to permit wires 34 extending to or from the plug 28 to extend out from the closure. In this manner, the marginal edges of the half-sections 12 and 14 do not close upon the wires. Recess 30 is of sufficient length to be compatible with the dimensions of the plug so as to accommodate a plurality of adjacent wires, but because the closed cell, cellular polymer is compressible, the polymer will be squeezed or pressed around the wires and along the opening 32 thereby enveloping the plug.

The closure 10 is provided with a suitable latching or engagement means to hold the closure in a closed condition when deployed for holding a plug, but permits easy access to the plug. One type of latch, as shown in the drawings, includes a snap latch 36 mounted on side wall 18 of complemetary member 12, and includes an inwardly turned nose or hook 38. The opposite side wall 18 of complementary member 14 is provided with detent 40, so that in an over and under engagement of mating marginal edges the latch 36 flexes or snaps over detent 40 whereby nose 38 locks onto the detent. The closure is then secured in a closed condition, and the plug is unaccessible and protected from the elements. Other suitable locking arrangements may be employed for securing the assembly in a locked position, such as a tongue and groove wherein a tongue is oriented on one wall of a first member and a complementary groove for receiving the tongue is oriented on the second member so that when the assembly is closed, the tongue locks into the groove.

Figure 2:
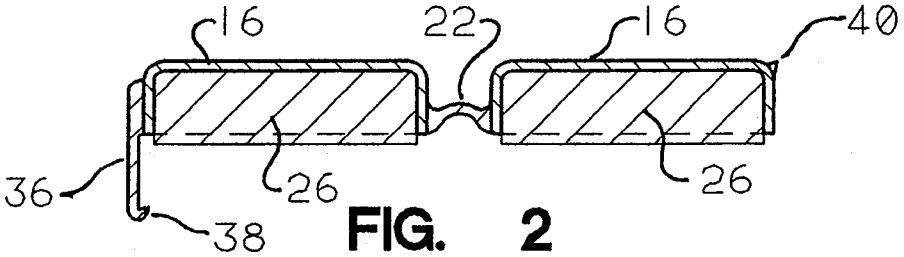
FIG. 2 is sectional view of the device of FIG. 1 showing the polymer in place.
Figure 4:
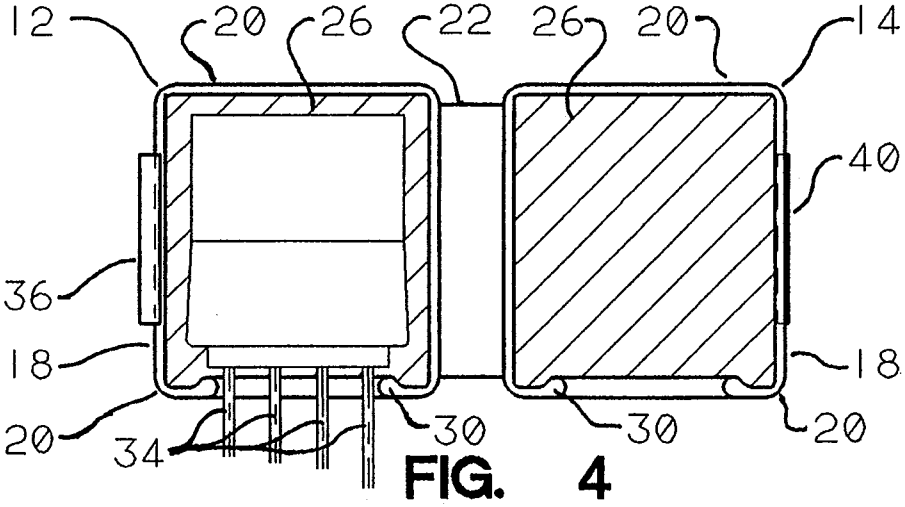
FIG. 4 is a plan view of the device of FIG. 1 showing the plug in place.

As best seen if FIG. 2, each complementary half-section or member 12 and 14 is filled with a closed cell, cellar polymer 26 of the type described above. Although the volume of each half section 12 and 14 may be the same or different, and although the volume of the polymer insert for each half member may be the same or different, it is preferable that the combined volume of polymer insert be greater than the combined volume of the chamber 24 formed upon closing the members. The polymer is characterized as being moisture resistant because of its closed cell structure, and further is readily compressible. Thus, as shown in FIG. 4, the protector 28 is placed in one of the two half member, e.g., member 12, and the lead wires 34 extending from the wiring system of the vehicle protude through or over recess 30. When the members 12 and 14 are pivoted about hinge 20 to a closed position, the polymer is deformed or compressed so as to envelop the plug, and the latching means secures the protector in a closed condition. In this manner, the plug is protected from the elements, especially from moisture which can corrode the metal parts of the plug. When it is desired to use the plug such as to connect the wiring system of an auxiliary vehicle, e.g., trailer, the protector is opened and the male elements of the wiring system are connected to the plug.

Figures 5, 6, 7:
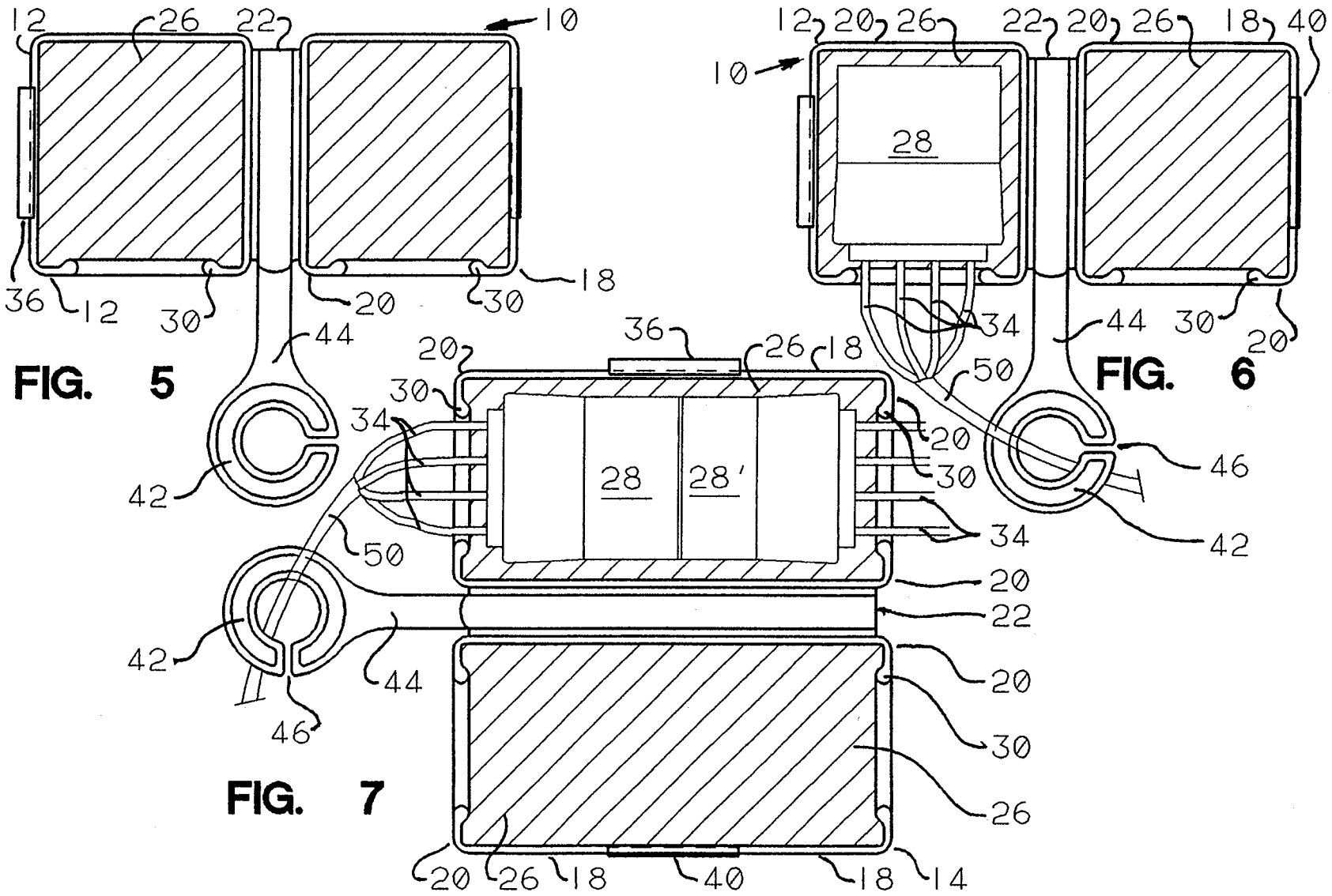
FIG. 5 is a plan view of the closure of my invention showing an alternative embodiment.
FIG. 6 is a view similar to FIG. 5 but showing the closure suspended on a lead wire.
FIG. 7 is a plan view of the closure of my invention showing yet another embodiment.

In accordance with an alternative embodiment of the invention as shown if FIGS. 5 and 6, the closure or protector 10 is provided with a split ring 42, preferably extending laterally from the hing 22 and formed integrally therewith. Thus, stiffening rib 44 extends from hinge 22, and ring or clip 42 has a radial split or slit 46 to permit temporary flexural opening. When a vehicle is hitched to another and the electrical system connected between vehicles by the plug 28, the protector or closure 10 can be hung by the split ring 42 onto the lead wire or cable 50 from the plug 28, thereby providing easy storage and quick access of the protector. When the plug is encased by the protector (no electrical connection is being made), the closed cell, cellular polymer envelops the plug as explained above in the description of the other embodiment. If the closure is not deployed as a protector, but rather the plug is being used to make an electrical connection, hanging the protector on the wires minimizes loss of the protector and yet provides for immediate access to the protector when the plug is disconnected. It is preferrable to form the complete unit as an integral unit, such as from extruded or molded polyethylene or polyvinyl chloride.

A still further embodiment of the invention is illustrated in FIG. 7 showing a protector or closure 10 for two plugs 28 and 28', which may be electrically connected as by a complementary male and female connection. The opposed end walls 20 of each half member 12 and 14 are provided with elongated recesses 30 and 30'. When the members are brought to a closed position and the two members are locked together, elongated openings 32 and 32' are formed along the interface of the complementary members. In this manner, lead wires 34 and 34' can extend from both sides of the protector to different electrical connections. As with the prior embodiments described above, the closed cell, cellular polymer envelops the plugs thereby providing a substantially moisture free environment for the plugs. Also, for this embodinment, the protector may be provided with a split ring 42 as shown in FIG. 7, and where desired a second split ring (not shown) may extend from the opposite side of the hinge.

The foregoing detailed description has been given for clearness of understanding only, and no unnecessary limitations should be understood therefrom, as modifications will be obvious to those skilled in the art.

What is claimed is:

1. A closure adaptable for enclosing and protecting an electric plug extending from a vehicle, comprising:

(a) a box-like enclosure having first and second complementary members, each of said members having side walls with marginal edges interfacing with each other in abutting relationship when said closure is in a closed condition;

(b) a hinge interconnecting said members along the marginal edge of one side wall of each of said members;

(c) a recess in a marginal edge of at least one side wall of said member thereby forming an opening along the interface of said first and second members when in closed condition to permit electric wires to extend from said plug outwardly from said closure; and (d) a closed cell, cellular polymer encased in each of said first and second members, (i) said polymer being substantially moisture resistant and compressible, (ii) and said polymer having a combined volume greater than the combined, interior volume of said closure when said closure is in an open condition permitting said first and second members to close when brought into abutting relationship and causing compression of said polymer to substantially envelop said plug thereby forming a water-tight seal.

2. A closure according to claim 1 wherein said closed cell, cellular polymer is polyvinyl chloride.

3. A closure according to claim 1 wherein said closed cell, cellular polymer is cellular rubber.

4. A closure according to any one of claims 1–3 wherein said cellular polymer has an integrally formed, substantially nonporous skin and a closed cell core.

5. A closure according to claim 1 wherein said closure further includes interconnecting means to rigidly connect said first and second members when in closed condition.

6. A closure according to claim 1 further including a split ring extending from said hinge and formed integrally therewith for accommodating wires extending from said plug.

7. A closure according to claim 6 wherein said split ring is formed of a flexible material, and further is provided with a radial slit to permit a temporary flexural opening in said split ring.

8. A closure according to claim 7 wherein said flexible material is polyethylene.

9. A closure according to claim 1 wherein said recess is transversely disposed to said hinge.

10. A closure according to claim 1 wherein said first and second members are substantially symmetrical.

11. A closure according to claim 4 wherein said closure includes interconnecting means to rigidly connect said first and second members when in closed condition, and further includes a split ring extending from said hinge and formed integrally therewith for accommodating wires extending from said plug.

12. A closure adaptable for enclosing and protecting an electric plug extending from a vehicle, comprising: (a) a box-like enclosure having first and second complementary members, each of said members having side walls with marginal edges interfacing with each other in abutting relationship when said closure is in a closed condition; (b) a hinge interconnecting said first and second members along the marginal edge of one side wall of each member, said first and second members and said hinge formed as an integral structure; (c) a recess in a marginal edge of complementary side walls transversely disposed to said hinge thereby forming an opening along the interface of said first and second members when in closed condition to permit electric wires to extend from said plug outwardly from said closure; (d) a split ring extending laterally from said hinge and formed integrally therewith, said split ring formed of a flexible material and having a radial slit to permit a temporary flexural opening; and (e) a closed cell, cellular polymer encased in each of said first and second members and having a combined volume greater than the combined volume of said closure, said polymer (i) being substantially moisture resistant, and (ii) being sufficiently compressible to permit said first and second members to close when brought into abutting relationship with the plug encased and to substantially envelop said plug thereby forming a water-tight seal.

* * * * *